US008965259B2

(12) United States Patent
Sahara

(10) Patent No.: US 8,965,259 B2
(45) Date of Patent: Feb. 24, 2015

(54) IMAGE HEATING APPARATUS

(71) Applicant: Canon Kabushiki Kaisha, Tokyo (JP)

(72) Inventor: Hiroshi Sahara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 13/672,086

(22) Filed: Nov. 8, 2012

(65) Prior Publication Data

US 2013/0136515 A1 May 30, 2013

(30) Foreign Application Priority Data

Nov. 29, 2011 (JP) ..... 2011-260162

(51) Int. Cl.
*G03G 15/20* (2006.01)

(52) U.S. Cl.
CPC ..... *G03G 15/2053* (2013.01)
USPC ..... 399/329

(58) Field of Classification Search
USPC ..... 399/329; 362/186, 217.11, 378
See application file for complete search history.

(56) References Cited

U.S. PATENT DOCUMENTS

| | | | | |
|---|---|---|---|---|
| 2,806,942 | A * | 9/1957 | Oharenko | 362/275 |
| 6,769,794 | B2 * | 8/2004 | Huang | 362/363 |
| 7,570,895 | B2 | 8/2009 | Ando et al. | |
| 7,773,931 | B2 | 8/2010 | Jung et al. | |
| 7,792,448 | B2 | 9/2010 | Ando et al. | |
| 8,032,069 | B2 | 10/2011 | Shin et al. | |
| 8,346,106 | B2 | 1/2013 | Takenaka et al. | |
| 2004/0042216 | A1 | 3/2004 | Huang | |
| 2009/0092423 | A1 | 4/2009 | Shin et al. | |
| 2009/0110451 | A1 | 4/2009 | Jung et al. | |
| 2009/0175645 | A1 * | 7/2009 | Seol et al. | 399/69 |
| 2011/0020018 | A1 * | 1/2011 | Takenaka et al. | 399/33 |
| 2011/0091254 | A1 | 4/2011 | Shin et al. | |
| 2011/0164906 | A1 | 7/2011 | Ishida et al. | |
| 2013/0121737 | A1 * | 5/2013 | Keino et al. | 399/329 |

FOREIGN PATENT DOCUMENTS

| | | | |
|---|---|---|---|
| JP | 2006-251479 | A | 9/2006 |
| JP | 2009-93141 | A | 4/2009 |
| JP | 2009-104114 | A | 5/2009 |
| JP | 2011-28037 | | 2/2011 |
| JP | 2011-113013 | A | 6/2011 |

OTHER PUBLICATIONS

Chinese Office Action dated Nov. 21, 2014, issued in counterpart Chinese Application No. 201210486494.X, and English-language translation thereof.

* cited by examiner

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

An image heating apparatus for heating an image formed on a sheet includes an endless belt; a roller contactable with the endless belt to form a nip for nipping and feeding the sheet; a heater provided inside the endless belt; a guiding member, provided inside the endless belt, for guiding rotation of the endless belt; a reinforcing member, provided between the endless belt and the heater in a radial direction of the heater, for reinforcing the guiding member, the reinforcing member being provided with an opening to permit radiant light from the heater to reach the endless belt; a protecting member, provided between the heater and the reinforcing member in the radial direction so as to oppose the endless belt through the opening, thus preventing contact between the endless belt and the heater.

12 Claims, 9 Drawing Sheets

PRIOR ART

PRIOR ART (a)

PRIOR ART (b)

IMAGE HEATING APPARATUS

FIELD OF THE INVENTION AND RELATED ART

The present invention relates to an image heating apparatus suitably usable as a fixing device for an image forming apparatus of an electrophotographic type, electrostatic recording type or the like image formation process, such as a copying machine, LBP or the like. The image heating apparatus is usable for a glossiness increasing device for increasing a glossiness of an image by heating the image fixed on a recording material, as well as the fixing device.

Conventionally, a heating roller type image heating apparatus is used in an image forming apparatus employing the electrophotographic type, electrostatic recording type or the like process. However, the heating roller type image heating apparatus requires large amount of electric power and long start-up time, since a heat roller having a large thermal capacity is heated. Recently, in order to meet the demand for energy conservation and quick start, an image heating apparatus of a belt type using a heating belt has been proposed.

Referring first to FIG. 8, a belt type image heating apparatus will be described. A heating belt 42 (partly broken to show an inside thereof) and a pressing member 41 are press-contacted to each other by pressure applying means (unshown). There is provided a sliding member 47 as a back-up member at an opposing portion to a pressing member 41 inside the heating belt 42 to close-contact to and to drive the heating belt 42. A heating source 45 for heating an inner surface 42*a* of the heating belt 42 and the sliding member 47 is provided at a position spaced from the heating belt 42 inside the heating belt 42.

In order to form a uniform nip N between the heating belt 42 and the pressing member 41, the sliding member 47 is supported by a sliding member holder 43, and the sliding member holder 43 is pressed and supported by a supporting member 46 for pressing the sliding member holder 43 longitudinally uniformly. The holder 43 functions also to guide the rotation of the belt, and the supporting member 46 function of reinforcing the holder 43. As for the heating source 45, a halogen lamp or the like is used, the radiant heat of the heating source 45 is transferred to the inner surface 42*a* of the heating belt 42 and to the sliding member 47 through a slit 43*a* provided in the sliding member holder 43. The inner surface 42*a* of the heating belt 42 is colored black to raise heat transfer efficiency.

In order to assure a heat efficiency, the supporting member 46 is provided with an opening 46*a* extending over a substantially entire longitudinal range. The heating source 45 is exposed through the opening 46*a* such that the radiant heat from the heating source 45 directly heats the inner surface 42*a* of the heating belt 42.

On the other hand, a fixing device is known in which a reinforcing member provided with a plurality of slits inclined relative to a belt traveling direction between the heating source and the heating belt to heat the belt uniformly in a widthwise direction (Japanese Laid-open Patent Application 2009-104114).

In an image heating apparatus 40 shown in FIG. 9, since the heating source 45 is exposed to the heating belt 42, the following problems arise. The description will be made referring to FIG. 9. Part (a) of FIG. 9 shows a state in which a recording material P passes through the image heating apparatus 40 in the direction indicated by the arrow A. Part (b) of FIG. 9 shows a state in which a leading end of the recording material P is not separated from the heating belt 42 with the result of sheet jam in the image heating apparatus.

As shown in part (b) of FIG. 9, the heating source 45 is exposed to the heating belt 42, and therefore, when the sheet jam occurs in the image heating apparatus, the heating belt 42 is deformed by the jammed sheet, the heating belt 42 may be contacted to the heating source 45. If the amount of the jammed paper is large, in such an occasion, the heating belt 42 and the heating source 45 is contacted strongly even to such an extent that the surface glass of the halogen lamp, if it is used as the heating source, is physically broken.

Even if the lamp is not physically broken, the contact to the halogen lamp results in deprivation of the heat at the contact portion and in a temperature difference between the contact portion and the non-contact portion. The temperature of a halogen lamp instantaneously rises in operation, and therefore, the thermal expansion difference may induce the glass breakage.

In addition, a foreign matter such as grease may be deposited from the inner surface of the belt onto the heating source, with the result of the breakage of the heating source. If the heating belt is folded or cracked, it cannot be uniformly heated. Furthermore, the temperature of the heating belt cannot be detected correctly with the result of a problem in the fixing property. With the downsizing of the image heating apparatus, the distance between the inner wall of the heating belt and the heating source 6 becomes shorter, the above-described problems are significant.

With the structure disclosed in Japanese Laid-open Patent Application 2009-104114, even if the sheet jam occurs in the image heating apparatus, the heating belt is deformed by the jammed paper so that the contact of a heat source and the heating belt or the foreign matter such as the grease is less.

However, a wide ladder-like shield portion is disposed between the heating source and the inner surface of the heating belt, and therefore, a sufficient opening is not formed, and the heat efficiency of the heating of the heating belt from the heating source significantly decreases. In addition, a supporting member provided with the shield portion also functions as pressing supporting member for a sliding member holder, and therefore, the deformation by the pressing may easily results. Therefore, the distance between the supporting member and the heating source should be such that the supporting member is assuredly not contacted to the heating source, which is against the downsizing.

SUMMARY OF THE INVENTION

Accordingly, it is a principal object of the present invention to provide an image heating apparatus with which the contact between the belt and the heater can be prevented with minimum blocking of the radiant light from a heater to a belt.

According to an aspect of the present invention, there is provided an image heating apparatus for heating an image formed on a recording material, comprising an endless belt; a roller contactable with said endless belt to form a nip for nipping and feeding the recording material; a heater provided inside said endless belt; a guiding member, provided inside said endless belt, for guiding rotation of said endless belt; a reinforcing member, provided between said endless belt and said heater with respect to a radial direction of said heater, for reinforcing said guiding member, said reinforcing member being provided with an opening to permit radiant light from said heater to reach said endless belt; a protecting member, provided between said heater and said reinforcing member with respect to said radial direction so as to oppose said endless belt through said opening, thus preventing contact between said endless belt and said heater.

These and other objects, features, and advantages of the present invention will become more apparent upon consideration of the following DESCRIPTION OF THE PREFERRED EMBODIMENTS of the present invention, taken in conjunction with the accompanying drawings.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment (Image Forming Apparatus)

Figure 2:
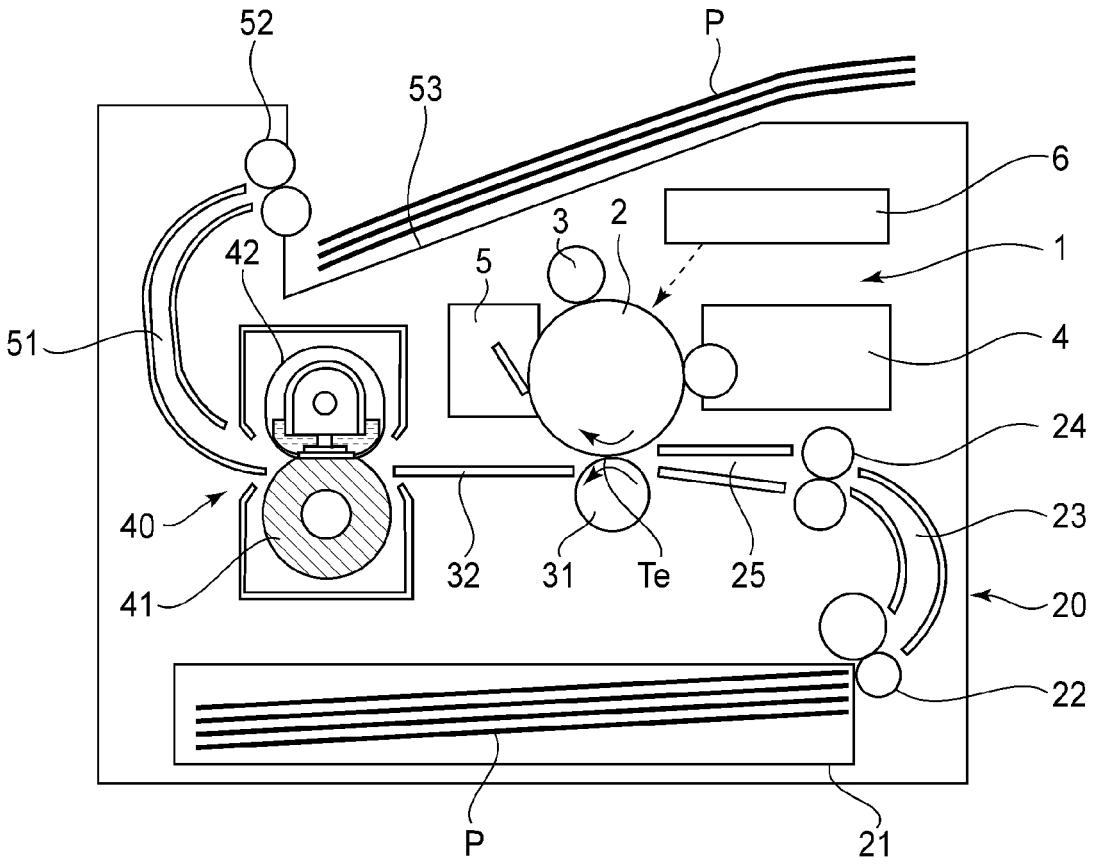
FIG. 2 is a schematic sectional view of an image forming apparatus using the image heating apparatus according to an embodiment of the present invention.

Referring to FIG. 2, an image forming apparatus using an image heating apparatus according to this embodiment will be described. The image forming apparatus of FIG. 2 is a monochromatic color (black) image forming apparatus using an electrophotographic image forming process. In the image forming apparatus, there is provided an image forming station 1 for forming an image in the center portion. The image forming station 1 includes a drum type electrophotographic photosensitive member 2 (photosensitive drum) as an image bearing member, around which a charger 3, a developing device 4 and a drum cleaning device 5 are provided, and an exposure device 6 is provided above the image forming station 1. The developing device 4 accommodates black toner.

The photosensitive drum 2 is a negative charging OPC photosensitive member and comprises an aluminum drum base member and a photoconductive layer, and is rotated in the direction indicated by the arrow (clockwise) at a predetermined process speed by a driving device (unshown). The charger 3 as charging means is supplied with a charging bias voltage from a charging bias voltage source (unshown) to charge a surface of the photosensitive drum 2 uniformly to a negative predetermined potential. The developing device 4 develops (visualizes) the electrostatic latent image formed on the photosensitive drum 2 into a toner image with the black toner.

A developing method of the developing device 4 may be a contact type developing method in which a mixture of the toner particles and the magnetic carrier particles (developer) are fed by magnetic force and are contacted to the photosensitive drum 2 to develop the latent image.

A transfer roller 31 as transferring means is made of an elastic member and is contacted to the photosensitive drum 2 at a transfer portion Te. In this embodiment, the transferring means is a transfer roller 31, but may be a transfer blade contacted to the photosensitive drum 2, the transfer blade being supplied with a high voltage when is toner image is to be transferred onto a transfer material. The drum cleaning device 5 removes and collects untransferred toner remaining on the surface of the photosensitive drum 2.

The exposure device 6 outputs a laser beam modulated corresponding to image information from a laser output portion (unshown) to expose the surface of the photosensitive drum 2 to the laser beam by way of a high speed rotation polygonal mirror (unshown) and so on. By this, an electrostatic latent image is formed in accordance with the image information on the surface of the photosensitive drum 2 charged by the charger 3.

A sheet feeding unit 20 comprises a sheet feeding cassette 21, a pair of pick-up rollers, a feeding guide 23, a pair of registration rollers a and a pre-transfer feeding guide 25, and feeds the recording material P from the sheet feeding cassette 21 to the transfer portion Te.

Downstream of the transfer portion Te with respect to a sheet feeding direction, there is provided an image heating apparatus 40 comprising a heating belt 42 enclosing a heat source, and a pressing roller 41, and between the transfer portion Te and the image heating apparatus 40, there is provided a pre-fixing feeding guide 32. Downstream of the image heating apparatus 40 with respect to the sheet feeding direction, there are provided a sheet discharging roller pair 52, and a sheet discharge feeding guide 51 for guiding the recording material P fed from the image heating apparatus 40 in the sheet discharging roller pair 52.

(Image Forming Operation)

An image forming operation of the image forming apparatus will be described. When an image formation start signal is produced, the photosensitive drum 2 being rotated at the predetermined process speed is charged uniformly to the negative polarity by the charger 3. The exposure device 6 converts an image signal to a light signal (laser beam) using a laser output portion (unshown), and the laser beam scans the charged photosensitive drum 2.

Then, the black toner is deposited on the electrostatic latent image formed on the photosensitive drum 2 by the developing device 4 supplied with a developing bias voltage of the same polarity as the charge polarity (negative) of the photosensitive drum 2, so as to visualize the latent image into a toner image. On the other hand, the recording material P is fed by the pick-up roller pair 22 from the sheet feeding cassette 21, at a timed relationship with the leading end of the toner image on the photosensitive drum 2 moving toward the transfer portion Te. The recording material P reaches the registration roller 24 along the feeding guide 23, and is fed to the transfer portion Te in timed relationship with the toner image formed on the photosensitive drum 2.

Onto the recording material P fed to the transfer portion Te, the black toner image is transferred by the transfer roller 31 supplied with a transfer bias voltage of the polarity (positive) opposite to the toner. The recording material P having the toner image is fed to the image heating apparatus 40, where the toner image is heated and pressed by a fixing nip formed between a heating unit provided with the heating belt 42 and a pressing unit provided with the pressing roller 41, so that the toner image is heat fixed on the surface of the recording material P. The recording material P having passed through the fixing unit 40 is fed along the sheet discharge feeding guide 51, and then is sheet discharged to an outside sheet discharge tray 53 by the sheet discharging roller pair 52, thus completing the series of image forming operations.

(Image Heating Apparatus)

Referring to FIG. 1, the image heating apparatus according to this embodiment will be described. A heating belt (endless belt) 42 which is a flexible belt member rotatable in contact with a pressing roller 41 as a pressing member is nipped between the pressing roller 41 and a sliding plate 47 as a back-up member. The sliding plate 47 contacts an inner surface of the heating belt 42 to form a nip N by the heating belt 42 and the pressing roller 41, through which the recording paper carrying the image is passed, during which the toner image is heated to fix it into a fixed image.

The heating belt 42 comprises a base material of metal such as nickel or SUS or heat resistive resin material such as polyimide, polyamide-imide or PEEK, an elastic layer on the base material and a parting layer thereon. A thickness of the heat resistive resin material is 30-200 μm, and the parting layer is made of fluorinated resin material. The thickness of the metal base material is 30 μm-100 μm, and the elastic layer between the base material and the parting layer is a silicone rubber layer having a thickness of 100-1000 μm.

A back side of the heating belt 42 is coated with a heat resistive black paint to absorb the heat from the heat source efficiently. The pressing roller 41 comprises a core material, an elastic layer thereon and a parting layer on the elastic layer. For example, the core material is made of steel, the elastic layer is made of foam silicone rubber layer, and the parting layer is a fluorine resin tube.

The sliding plate 47 is a metal plate, a ceramic plate or the like having a width of 5-20 mm, a length of 200-400 mm and a thickness of 0.5-2 mm, approximately. It may be provided with recessed and projected configuration to change the pressure distribution in the nip N. The plate member may be provided with a resin coating of fluorinated resin material or the like, or a glass coating or the like. In this embodiment, the sliding plate 47 is an aluminum flat plate having a width of 10 mm, a length of 270 mm and a thickness of 1 mm, the surface of the aluminum flat plate being coated with fluorinated resin.

A sliding plate holder (guiding member) 43 is made of heat resistive resin material, metal or the like and function to support the sliding plate 47. It is provided with a slit opening 43*a* extending in the longitudinal direction in order to radiate the radiant heat H from the heating source 45 directly to the sliding plate 47. The sliding plate holder 43 also has a guiding function for assuring a rotation orbit of the heating belt 42.

(Heating Source and Protection Therefor)

As shown in FIG. 1, the heating source 45 is disposed at a position spaced from the heating belt 42 inside the heating belt 42, preferably at or adjacent to a central portion. In this embodiment, a halogen lamp (halogen heater) is used. In addition, the structure is such that the radiant heat (radiant light) H from the heating source 45 is projected to substantially the entire area of the inner surface 42*a* of the heating belt 42 that is not blocked by the sliding plate holder 43. The radiant light heats the sliding plate 47 through the slit opening 43*a* provided in the sliding plate holder 43.

A supporting member 46 is provided and is provided with an opening 46*a* extending substantially over the entire length to radiate the radiant heat H from the heating source 45 to the inner surface 42*a* of the heating belt 42. The supporting member 46 is made of metal, highly heat resistive resin material or the like and is pressed toward the pressing roller at the opposite longitudinal end portions by unshown pressure applying means. The supporting member 46 functions also as a reinforcing member for the holder 43 which is effective to guide the belt. As shown in FIG. 1, the supporting member (reinforcing member) 46 is disposed between the heater 45 and the endless belt 42 in a radial direction of the heater. The supporting member 46 is provided with the opening 46*a* to permit the radiant light generated by the heater 45 to reach the endless belt 42. The sliding plate holder 43 is pressed uniformly over the length through the supporting member 46, and the nip N is formed uniformly between the heating belt 42 and the pressing roller 41 by the sliding plate 47 as the back-up member.

Designated by reference numeral 44 is a protecting member for preventing contact between the endless belt 42 and the heater 45. The protecting member 44 is disposed between the heater 45 and the reinforcing member 46 in the radial direction of the heater 45 so as to oppose to the endless belt 42 through the opening 46*a*.

Figure 1A:
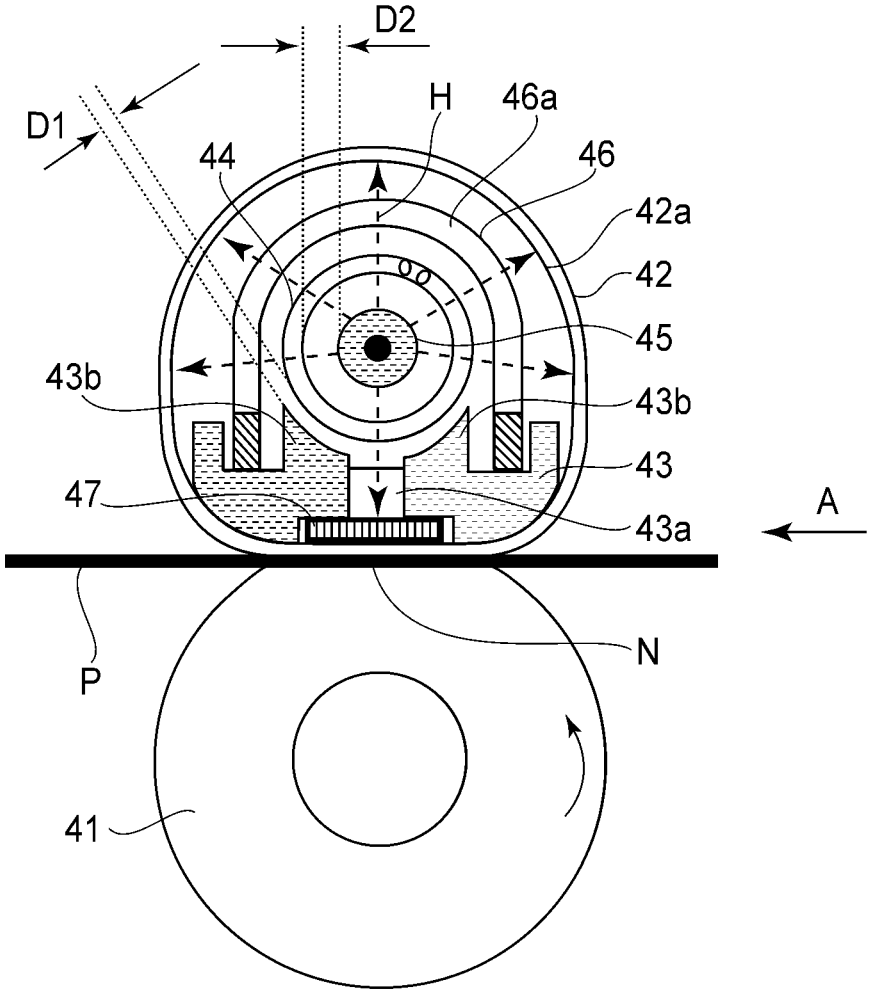
FIG. 1A is a schematic sectional view of an image heating apparatus according to a first embodiment of the present invention.
Figure 9:
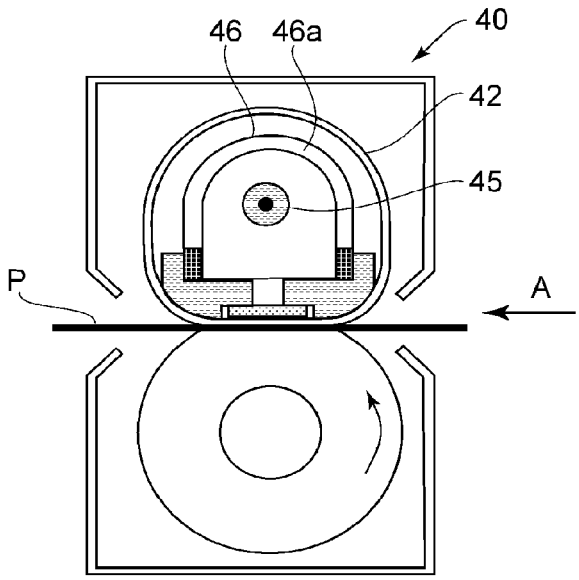
FIG. 9 is a schematic sectional view (a) of an image heating apparatus in a normal condition, and a schematic sectional view when the sheet jam has occurred, in the conventional example.
Figure 9:
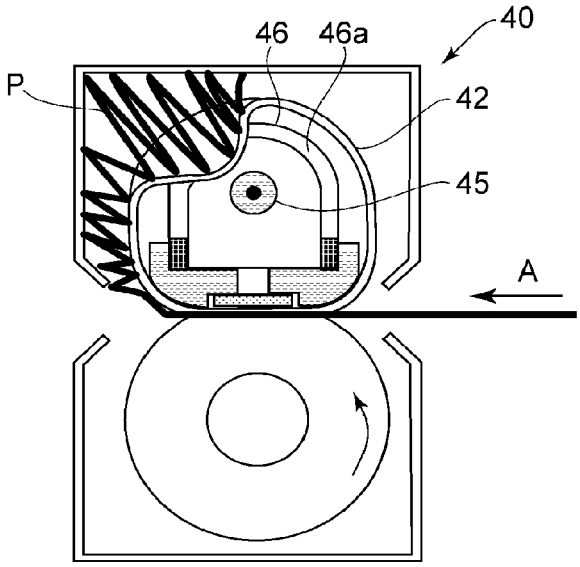

As shown in FIG. 1A, the protecting member 44 is a spiral spring provided along an outer surface of the heating source and is made of metal wire having a diameter of 0.5-3 mm. Even if the recording paper is jammed as shown in part (b) of FIG. 9, and the belt is deformed, the contact between the belt 42 and the heater 45 can be prevented. As shown in FIG. 1A, a distance D1 between the protecting member 44 and abutting portion 43*b* of the sliding plate holder 43 is shorter than a distance D2 between the protecting member 44 and the heating source 45.

By doing so, even if the protecting member 44 is deformed by the belt 42 upon the sheet jamming, the protecting member 44 contacts the abutting portion 43*b* before the protecting member 44 contacts to the heating source 45, and therefore, the contact between the protecting member 44 and the heating source 45 is avoided. As shown in FIG. 1, the abutting portion 43*b* is arcuate along an outer surface of the protecting member 44 and extends over the entire length of the heater.

Figure 1B:
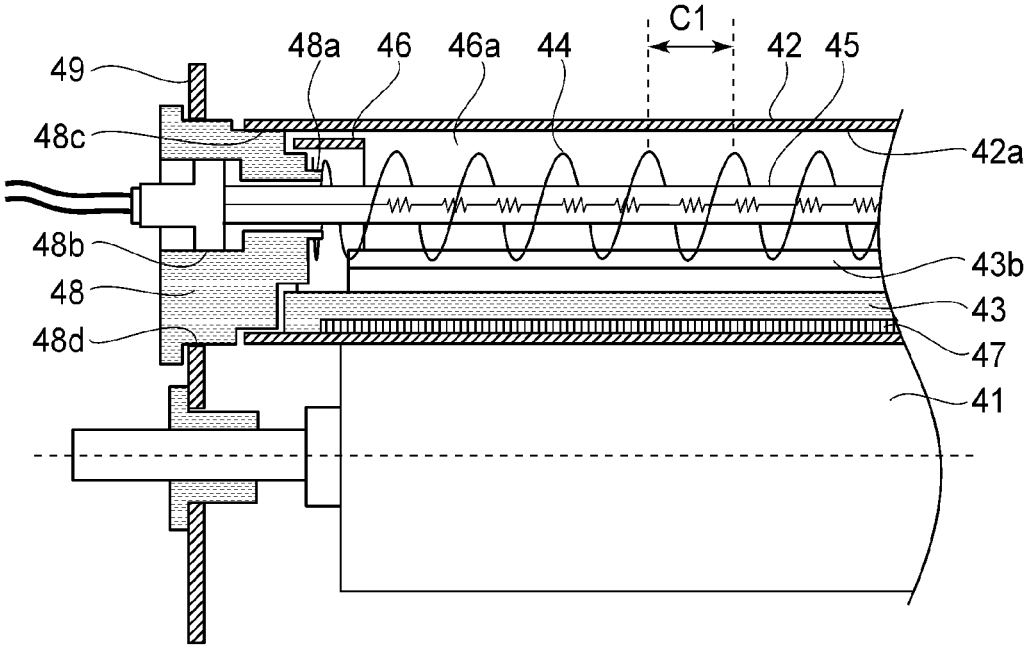
FIG. 1B is a schematic sectional view of the image heating apparatus as seen in a sheet feeding direction.

Referring to part (b) of FIG. 1, the protecting member 44 will be described further. Part (b) of FIG. 1 is a schematic sectional view of the image heating apparatus as seen from an upstream side (direction indicated by the arrow A) with respect to the sheet feeding direction in FIG. 1A. FIG. 1B shows only one end portion with respect to the longitudinal direction, but the structure at the opposite end is fundamentally the same although is symmetrical. The protecting member 44 has a spiral configuration having a pitch width C1 in the normal feeding condition (image heating) in the state that the sheet is fed normally, that is, without sheet jamming. The pitch width C1 is selected such that the radiant heat from the heating source 45 mostly reaches the inner surface 42*a* of the heating belt. An end portion of the protecting member 44 is connected with a flange member 48 at a connecting portion 48*a* in the flange member 48.

The flange member 48 is provided opposed to each of the opposite ends of the endless belt 42 and supports the heater 45. The flange member 48 is made of metal or highly heat resistive resin material, and is connected with the protecting member 44 in the connecting portion 48*a* and is connected with the heating source 45 in the connecting portion 48*b*. The flange member 48 also has a function of guiding the rotation of the belt 42. Furthermore, it is connected with a side plate 49 of the image heating apparatus in a connecting portion 48*d*, so that the heating source 45, the heating belt 42 and the protecting member 44 are integrally supported.

According to this embodiment, the heating source 45 is enclosed by the spiral spring-like protecting member 44, so that when the sheet jamming occurs in the image heating apparatus, it can be avoided that the jammed sheet deforms the heating belt 42 to bring the heating belt 42 into contact to the heating source. In addition, the protecting member 44 is constituted by a wire, and therefore, the radiant light from the heating source 45 sufficiently reaches the heating belt 42.

Furthermore, the heating belt 42, the heating source 45 and the protecting member 44 are supported by the same flange member 48, by which the relative position among the heating belt 42, the heating source 45 and the protecting member 44 can be made precise. For this reason, gaps between the heating belt 42, the heating source 45 and the protecting member 44 can be set to be necessary minimum levels, thus promoting the downsizing of the image heating apparatus.

Moreover, the distance between the protecting member 44 and the abutting portion 43*b* provided on the sliding plate holder 43 is made smaller than the distance between the heating source 45 and the protecting member 44. By doing so, even when the sheet jamming occurs, and the jammed sheet deforms the heating belt 42 and the protecting member 44, the heating source 45 can be protected assuredly. This is because the protecting member 44 abuts to the abutting portion 43*b* of the sliding plate holder 43 before contacting to the heating source 45.

Figure 4:
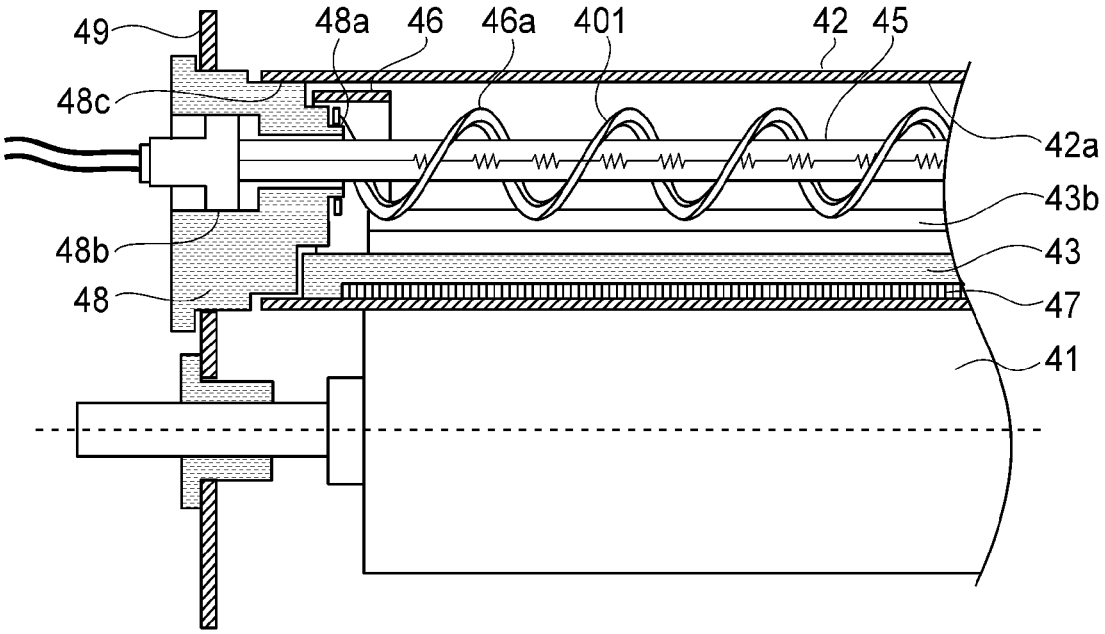
FIG. 4 is a schematic sectional view another example of a protecting member used in the apparatus of a second embodiment.

In this embodiment, the protecting member 44 is made of metal wire having a circular cross-sectional configuration, but the wire may have a rectangular cross-sectional configuration as shown in by 401 in FIG. 4. In such a case, it is preferable that a long side of the rectangular shape of the cross-section of the protecting member 401 extends in direction parallel with a radial direction of the heater, and a short side of the rectangular shape extends in parallel with the heater, since then a radiant light projection efficiency to the belt is high while assuring the strength of the protecting member.

Second Embodiment

Figure 3:
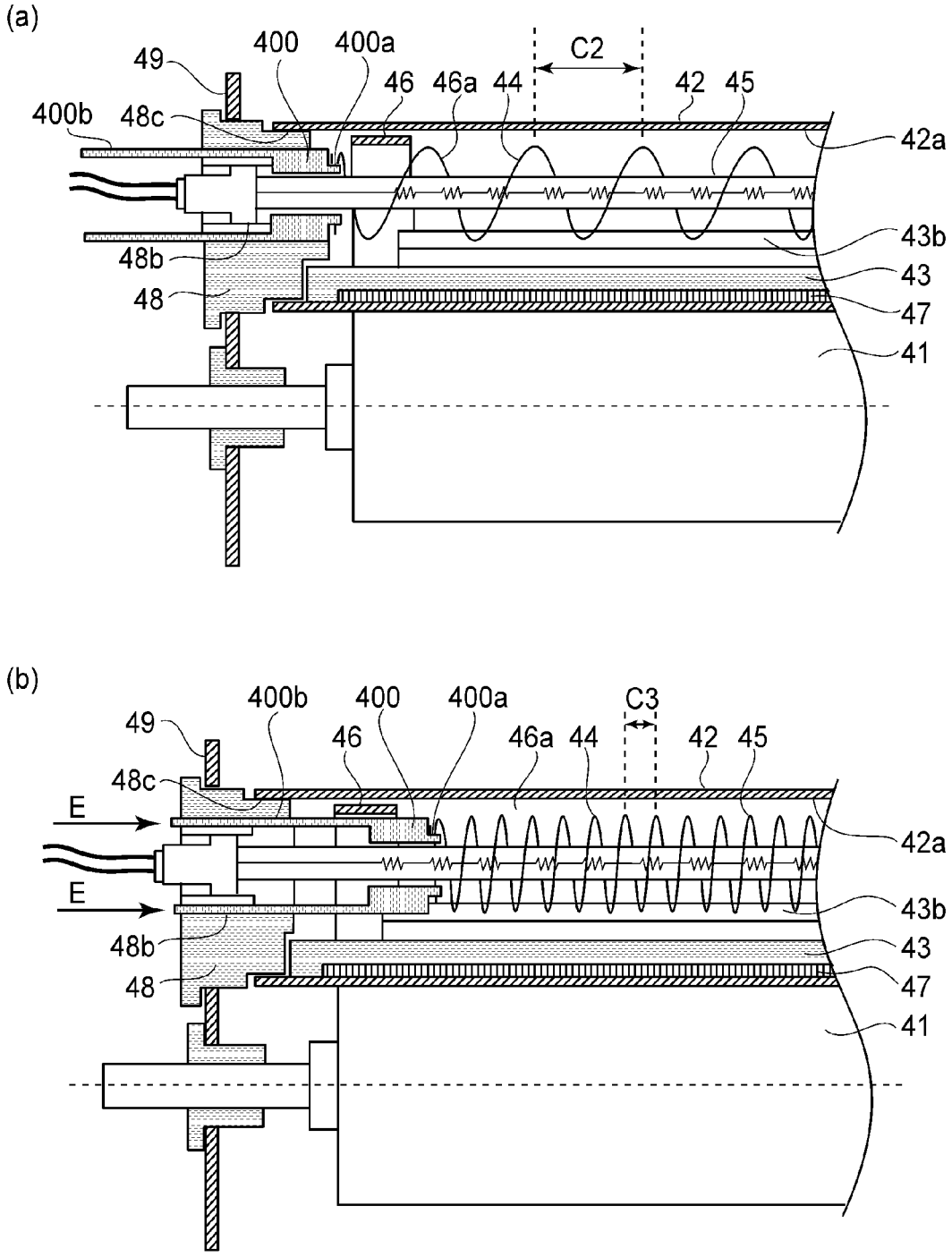
FIG. 3 is a schematic sectional view of the image heating apparatus (a) according to a second embodiment of the present invention as seen in the sheet feeding direction, during the image heating operation, and a schematic sectional view (b) as seen in the sheet feeding direction when the sheet jamming has occurred.

Referring to FIG. 3, a second embodiment of the present invention in which the protecting member is compressible (flexible) will be described. Part (a) of FIG. 3 is a schematic sectional view of an image heating apparatus as seen from an upstream with respect to a sheet feeding direction (direction indicated by the arrow A) during a normal feeding operation (image heating operation), similarly to the part (b) of FIG. 1. Part (a) of FIG. 3 shows only one end portion with respect to the longitudinal direction, but the opposite side has a fundamentally the same but symmetrical structure. As shown in part (a) of FIG. 3, a pushing member (expansion and contraction mechanism) 400 is provided in a flange member 48, which is movable in the longitudinal direction. The pushing member 400 is connected with the protecting member 44 in a connecting portion 400*a*. Part (b) of FIG. 3 shows a moving state of the pushing member 400.

In part (b) of FIG. 3, a pushing means (unshown) pushes the pushing portion 400*b* of the pushing member 400 in the direction of arrow E. Then, the protecting members 44 contracts in the direction of the arrow E through the pushing member 400. Therefore, the protecting member 44 has a pitch width C2 before the contraction, and the pitch width is changed to C3. As for the timing at which the pushing means pushes the pushing member 400, when sheet jamming detecting means (unshown) detects an occurrence of the sheet jamming, the pushing means operates to push the pushing member 400 as shown in part (b) of FIG. 3.

As described in the foregoing, in this embodiment, the pitch of the spiral spring-like protecting member enclosing the heating source is large in the normal sheet feeding state, so that the radiant efficiency to the heating belt is large. On the other hand, upon occurrence of the sheet jamming in the image heating apparatus, the pushing member pushes the protecting member, so that the pitch of the spiral protecting member is reduced. By doing so, the contact of the heating belt to the heating source by the deformation of the heating belt by the jammed sheet can be prevented further assuredly.

Also in this embodiment, the protecting member 401 having a rectangular cross-sectional configuration shown in FIG. 4 is usable.

Third Embodiment

Figure 5:
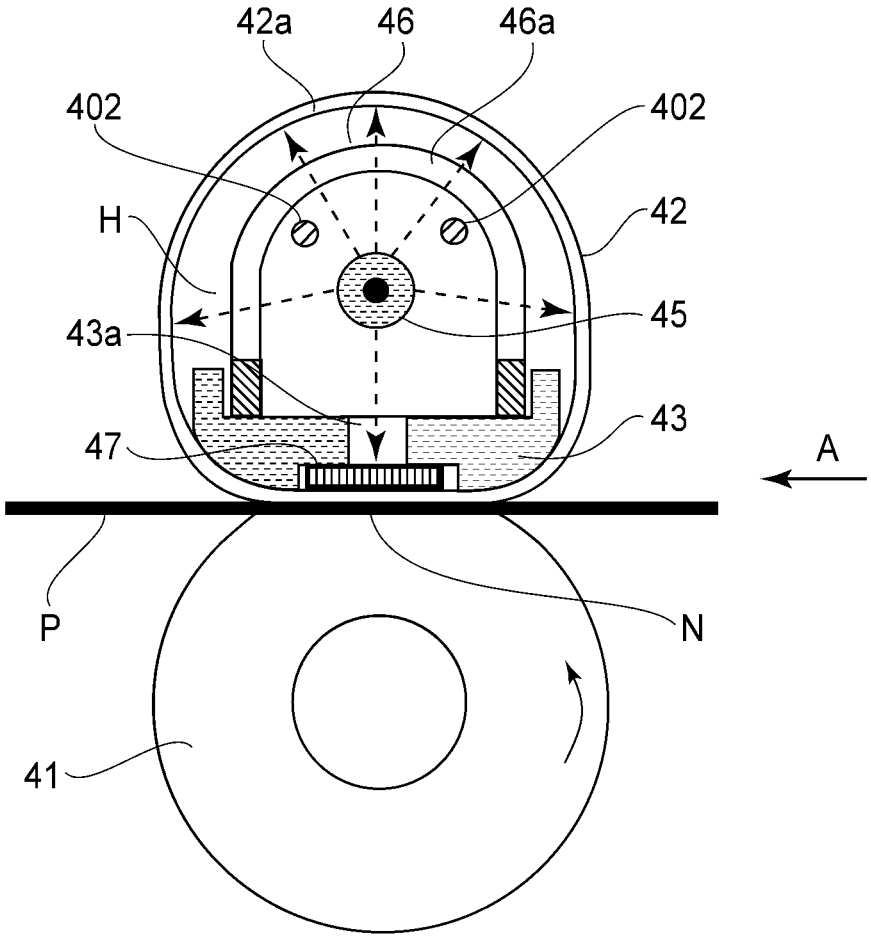
FIG. 5 is a schematic sectional view of an image heating apparatus according to a third embodiment of the present invention.
Figure 6:
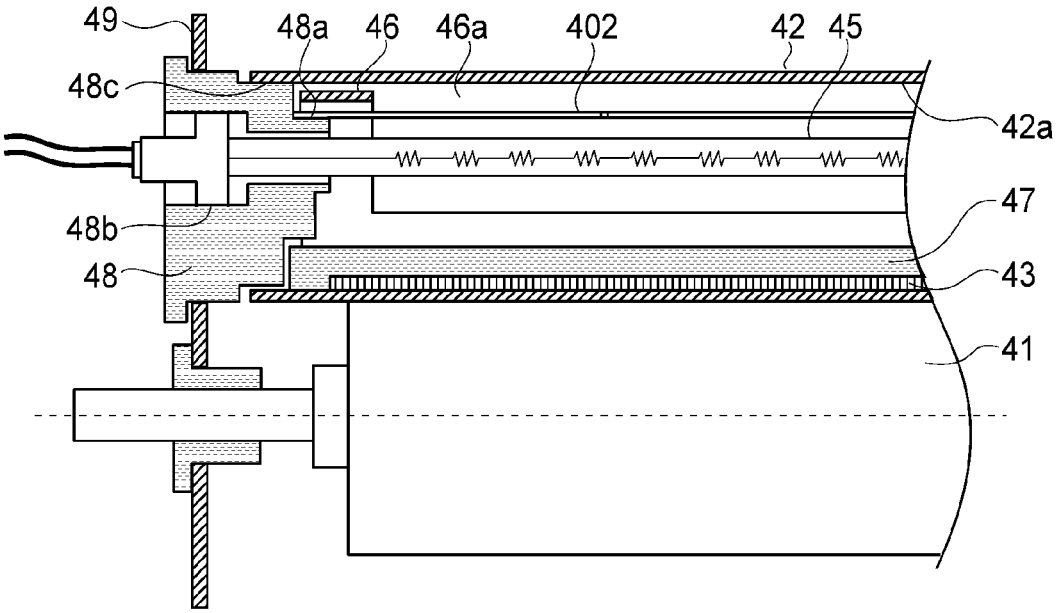
FIG. 6 is a schematic sectional view as seen in the sheet feeding direction of the image heating apparatus in the third embodiment.

Referring to FIGS. 5, 6, the description will be made as to a third embodiment of the present invention in which the protecting member is a metal wire in the form of a linear wire in a predetermined plane along an outer surface of the heating source. FIG. 5 is an enlarged schematic sectional view of the image heating apparatus similarly to FIG. 1A. In this embodiment, at least one linear metal wire 402 is extended over the entire length of the heating source 45 in the longitudinal direction between the heating belt 42 and the heating source 45. The metal wire 402 is disposed between the heating source 45 and the part of the heating belt 42 downstream of the nip N with respect to the sheet feeding direction so as to prevent the heating belt 42 from contacting the heating source 45 when the sheet jamming occurs.

When the position where the sheet jamming occurs is not limited to a particular position, a plurality of metal wires 402 are provided, preferably. The metal wire 402 has a diameter of 0.5 mm-3 mm so as to be durable against the deformation of the heating belt 42, and is disposed with a sufficient distance from the heating source so that the metal wire 402 is not contacted to the heating source due to the deformation of the heating belt 42.

Referring to FIG. 6, further description will be made. FIG. 6 is a schematic sectional view of the image heating apparatus as seen from an upstream side (direction indicated by the arrow A) with respect to the sheet feeding direction. FIG. 6 shows only one end portion with respect to the longitudinal direction, but the opposite side has a fundamentally the same but symmetrical structure. The metal wire 402 is connected with the flange member 48 at the connecting portion 48*a*. The metal wire 402 is stretched by stretching means (unshown) with an appropriate tension normally in consideration of flexure due to deformation of the heating belt 42 and thermal expansions of the inside parts of the heating belt.

The flange member 48 is connected with the heating source 45 and the heating belt 42 at the connecting portion 48*b* and the connecting portion 48*c*, respectively to integrally support the metal wire 402, the heating source 45 and the heating belt 42.

As described in the foregoing, in this embodiment, at least one substantially line metal wire is stretched between the heating source and the heating belt over the entire length. By doing so, when the sheet jamming occurs in the image heating apparatus, the metal wire prevents the heating belt from contacting to the heating source, which may be caused by deformation of the heating belt by the jammed sheet. In addition to that, because of use of a linear stretched metal wire, the heat efficiency of the radiant heat to the heating belt from the heating source can be assured sufficiently during normal heating operation.

In addition, the heating belt, the heating source and the metal wire are supported by the same flange member. By this, the relative position among the heating belt 42, the heating source 45 and the protecting member 44 which is the metal wire can be made precise, by which gaps between the heating belt 42, the heating source 45 and the protecting member 44 can be set to be necessary minimum levels, thus promoting the downsizing of the image heating apparatus.

By stretching the metal wire with a proper tension, even when the sheet jamming occurs, and the jammed sheet deforms the heating belt 42 and the protecting member 44, the heating source 45 can be protected assuredly.

In this embodiment, the protecting member is made of metal wire having a circular cross-sectional configuration, but the wire may have a rectangular cross-sectional configuration (metal plate material).

Modified Example 1

Figure 7:
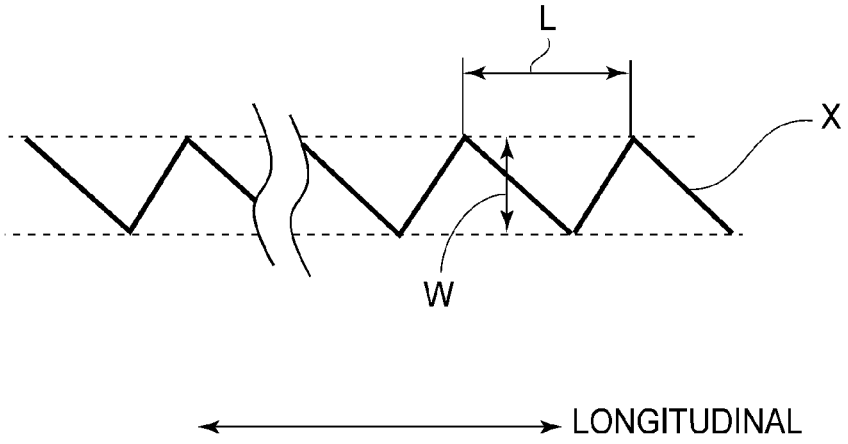
FIG. 7 illustrates a modified example of a protecting member in the third embodiment.
Figure 8:
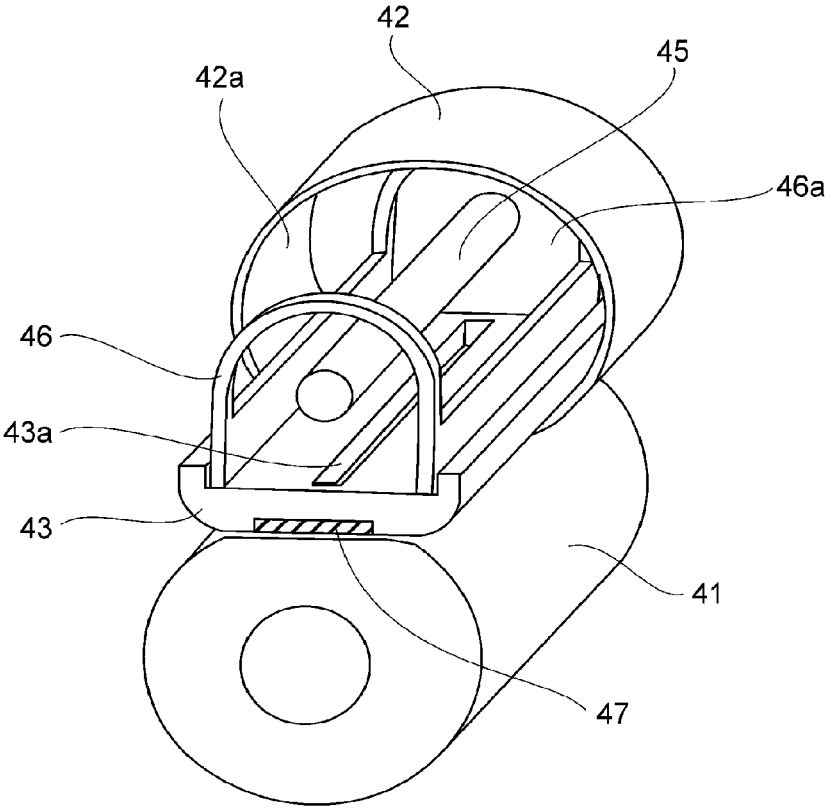
FIG. 8 is a schematic perspective view of a conventional image heating apparatus.

In the first and second embodiments, the wire as the protecting members are spiral, and to third embodiment, it is linear, but these structures are not inevitable to the present invention. For example, the third embodiment may be modified as shown in FIG. 7, in which a compressible spring metal wire X replaces the wire of the third embodiment. In this case, the width W can be made larger in order to avoid the contact to the heating source. In addition, by making it contractable upon occurrence of the sheet jamming, the pitch L can be reduced as compared with that during the normal sheet feeding (image heating), so that the protection for the heating source is further assured.

Modified Example 2

In the above-described embodiments, metal wires are used as the wire, but this is not inevitable to the present invention, and a material having a relatively high strength such as hard resin material is usable to protect the heating source upon occurrence of the sheet jamming. By using the protecting member is made of such a material (including metal material) at least partly passing the radiant heat from the heating source, the heat efficiency can be enhanced during the image heating operation. In this case, the protecting member protects the heating source and enhances the heat efficiency.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 260162/2011 filed Nov. 29, 2011 which is hereby incorporated by reference.

What is claimed is:

1. An image heating apparatus for heating an image formed on a recording material said apparatus comprising:

an endless belt;

a roller contactable with said endless belt to form a nip to nip and feed the recording material;

a heater provided inside said endless belt;

a guiding member, provided inside said endless belt, configured to guide rotation of said endless belt;

a reinforcing member, provided between said endless belt and said heater with respect to a radial direction of said heater, configured to reinforce said guiding member, said reinforcing member being provided with an opening to permit radiant light from said heater to reach said endless belt;

a protecting member, provided between said heater and said reinforcing member with respect to said radial direction so as to oppose said endless belt through said opening, thus preventing contact between said endless belt and said heater, wherein said protecting member includes a spiral wire being provided to surround said heater; and an expanding and contracting mechanism configured to expand and contract said spiral wire in a longitudinal direction of said heater.

2. An apparatus according to claim 1, further comprising a flange member opposing an end surface of said endless belt, wherein said protecting member is supported by said flange member.

3. An apparatus according to claim 2, wherein said heater is supported by said flange member.

4. An apparatus according to claim 1, wherein said expanding and contracting mechanism contracts said protecting member when sheet jamming is detected.

5. An image heating apparatus for heating an image formed on a recording material said apparatus comprising:

an endless belt;

a roller contactable with said endless belt to form a nip to nip and feed the recording material;

a heater provided inside said endless belt;

a guiding member, provided inside said endless belt, configured to guide rotation of said endless belt;

a reinforcing member, provided between said endless belt and said heater with respect to a radial direction of said heater, configured to reinforce said guiding member, said reinforcing member being provided with an opening to permit radiant light from said heater to reach said endless belt; and a protecting member, provided between said heater and said reinforcing member with respect to said radial direction so as to oppose said endless belt through said opening, thus preventing contact between said endless belt and said heater, wherein the distance between said protecting member and said guiding member is shorter than a distance between said protecting member and said heater.

6. An apparatus according to claim 5, further comprising a flange member opposing an end surface of said endless belt, wherein said protecting member is supported by said flange member.

7. An apparatus according to claim 6, wherein said heater is supported by said flange member.

8. An apparatus according to claim 5, wherein said protecting member includes a spiral wire being provided to surround said heater.

9. An apparatus according to claim 8, wherein further comprising an expanding and contracting mechanism configured to expand and contract said protecting member in a longitudinal direction of said heater.

10. An apparatus according to claim 9, wherein said expanding and contracting mechanism contracts said protecting member when sheet jamming is detected.

11. An apparatus according to claim 5, wherein said protecting member is a wire extending linearly in parallel with said heater.

12. An apparatus according to claim 11, comprising a plurality of such wires.

* * * * *